US005689095A

United States Patent [19]

Kawase

[11] Patent Number: 5,689,095

[45] Date of Patent: Nov. 18, 1997

[54] SWITCHING DEVICE

[75] Inventor: Toshihiro Kawase, Aichi, Japan

[73] Assignee: Kabushiki Kaisha Tokai Rika Denki Seisakusho, Aichi, Japan

[21] Appl. No.: 305,980

[22] Filed: Sep. 19, 1994

[30] Foreign Application Priority Data

Sep. 20, 1993 [JP] Japan ..... 5-050956
Sep. 20, 1993 [JP] Japan ..... 5-050957

[51] Int. Cl.[6] ..... H01H 13/70

[52] U.S. Cl. ..... 200/5 R; 200/6 A

[58] Field of Search ..... 200/4, 5 R, 5 A, 200/6 R, 6 A, 16 R, 17 R, 18, 512–517, 339

[56] References Cited

U.S. PATENT DOCUMENTS 4,590,338 5/1986 Suzuki ..... 200/5 R
4,611,102 9/1986 Ishida ..... 200/5 R
4,698,463 10/1987 Tanaka et al. ..... 200/5 R
4,947,461 8/1990 Yoshioka et al. ..... 200/5 R
4,975,547 12/1990 Nakayama et al. ..... 200/5 R
5,412,165 5/1995 Malone et al. ..... 200/5 R

FOREIGN PATENT DOCUMENTS

35718/88 8/1988 Japan ..... B65G 27/08

*Primary Examiner*—Michael L. Gellner
*Assistant Examiner*—Michael A. Friedhofer
*Attorney, Agent, or Firm*—Finnegan, Henderson, Farabow, Garrett & Dunner, L.L.P.

[57] ABSTRACT

A switching device includes a switch body, a base plate provided in the switch body, an operation knob provided in the switch body so as to pushed therein, an elastic member arranged on the base plate, the elastic member including a contact holder portion, which is elastically deformable, for switching a first switching member in response to a pushing operation of the operation knob, a switching knob provided near the operation knob; and a contact holder for switching a second switching member in response to a switching operation of the switching knob, the contact holder slidably arranged on the base plate.

8 Claims, 8 Drawing Sheets

SWITCHING DEVICE

BACKGROUND OF THE INVENTION

1. Field of the Invention

The present invention relates to a switching device which is constructed in such a manner as to perform a switching operation on a plural number of switching elements by a pushing operation of an operating knob which can be operated for its swinging motion in any of four directions.

The present invention further relates to a switching device which is provided with a first switching element to be switched on the basis of an operation of an operating knob and with a second switching element to be switched on the basis of an operation of a changeover knob.

2. Related Art

A switching device in the following construction (Refer, for example, to the Japanese Utility Model Application No. 35718/88) is available as a switching device, for example, for controlling a motor for an electric mirror constructed so as to regulate the direction of each of outer mirrors installed respectively on the left door and the right door of a motor car.

More specifically, the switching device is provided with an operating knob which, being installed on the switch body, can be operated for its swinging motion in any of four directions and is also provided with an elastic member made, for example, of silicone rubber and having a plural number of elastically deformable contact holders, which, being pushed down on the basis of a swinging operation of the operating knob, performs a switching operation for an operating switch on a wiring board arranged within the switch body. In addition, the switching device is formed in a construction with a changeover knob being provided in an opening formed in the central area of the operating knob in such a manner as to permit the changeover knob to slide in the horizontal direction and with contact holders provided on the above-mentioned wiring board and operates the changeover switch for a switching operation while the changeover knob slides on the wiring board by the effect of its sliding operation.

However, a switching device in the construction described above is capable of enabling the user to select one of the left mirror and the right mirror by performing a switching operation of the changeover switch by operating the changeover knob so as to perform a sliding motion and then to adjust the direction of the mirror on a selected side upward, downward, leftward, or rightward by performing a switching operation of the operating switch by operating the operating knob so as to set it into its performance of a swinging motion.

However, this type of switching device has had the disadvantage that the contact holder hits the switch body, causing relatively large collision noises, when the changeover knob is put into a sliding motion.

In order to deal properly with this disadvantage, it is a conceivable measure, for example, to fit an impact noise reducing cushion rubber piece to one of an end portion of the contact holder or the switch body facing the end portion of the contact holder.

Yet, such a construction, which can certainly reduce the operating noises generated at the time of a sliding operation of the changeover knob, additionally requires a cushion rubber piece, which results in an increase in the number of the component parts and also in an increase in the complexity of assembly and eventually results in an increase in the cost.

Here, specifically, the switching elements which are switched by means of the operating knob 1 mentioned above are disposed in a total of six elements, as shown in FIG. 10. In this case, the two switching elements 2*a* and 2*b* are disposed in two opposed positions in the two opposite corners of the operating knob formed in a rectangular shape, and two sets of switching elements respectively comprising the two switching elements 2*c* and 2*d* and 2*e* and 2*f* are disposed in positions slightly detached from the corner portion in the proximity of each of the remaining two corners of the operating knob 1.

In this construction, the two switching elements 2*a* and 2*c* located on the upper side in the Figure will be turned on at the same time when the upward operating part 1*a* of the operating knob 1 is operated so as to be pushed in, and, on the basis of this switch-on operation, the motor for upward and downward movements is set into its forward rotation, so that the mirror is rotated upward, and, when the downward operating part 1*c* of the operating knob 1 is operated so as to be pushed in, the two switching elements 2*b* and 2*f* on the lower side will be turned on at the same time, on the basis of which the motor for the upward and downward movement is rotated in the reverse direction, so that the mirror is rotated downward. Further, when the leftward operating part 1*b* of the operating knob 1 is operated so as to be pushed in, the two switching elements 2*a* and 2*e* on the left side will be turned on at the same time, on the basis of which the motor for the left side and the right side is put into its forward rotation, by which the mirror is rotated leftward, and, when the rightward operating part 1*d* of the operating knob 1 is operated so as to be pushed in, the two switching elements 2*b* and 2*d* will be turned on at the same time, on the basis of which the motor for the left side and the right side is put into its reverse rotation, so that the mirror is rotated rightward.

However, in case the operating knob 1 is pushed aslant in the switching device formed in the construction described above, the switching device will be at a disadvantage as described below. That is to say, in case the operating knob 1 has been operated by pushing a diagonally upper left point or by pushing a diagonally lower right point, the switching elements 2*a* or 2*b* alone will be turned on, but no power conducting path will be formed to the motor. However, in case the operating knob 1 is operated by pushing a diagonally upper right point or by pushing a diagonally lower left point, the switching element 2*c* and the switching element 2*d* in the next set, or the switching element 2*e* and the switching element 2*f* in the next set will be turned on at the same time, in which case both of the motor for the upward and downward movements and the motor for the leftward and rightward movements will be supplied with electric power.

Moreover, as regards the arrangement of the switching elements, it has hitherto been in practice also to arrange eight switching elements in a switching device as shown in FIG. 11. In this arrangement, pairs of two switching elements 3*a* and 3*b*, 3*c* and 3*d*, 3*e* and 3*f*, and 3*g* and 3*h* are arranged in adjacent individual corners of the operating knob 1.

Now, in this arrangement of the switching elements, the two switching elements 3*a* and 3*b* on the upper side in the Figure will be turned on at the same time in case the upper operating part 1*a* of the operating knob 1 is operated so as to be pushed in, and the switching elements 3*e* and 3*f* on the lower side will be turned on at the same time when the lower operating part 1*c* of the operating knob 1 is operated so as to be pushed in. Further, when the leftward operating part 1*b* of the operating knob 1 is operated so as to be pushed in, the two switching elements 3*c* and 3*d* on the left side will be turned on at the same time, and, when the rightward operating part 1*d* of the operating knob 1 is operated so as to be pushed in, the two switching elements 3*g* and 3*h* will be turned on at the same time.

However, also in the case of the switching device shown in this FIG. 11, a disadvantage similar to that appearing in the construction shown in FIG. 10 will be found to exist. In specific terms, the switching element 3*a* and the switching element 3*c* in the next set, or the switching element 3*f* and the switching element 3*g* in the next set, will be turned on when the operating knob 1 is operated at a point diagonally upper left of it or at a point diagonally lower right of it, but no power conducting path will be formed to the motor in this case. Yet, when the operating knob 1 is operated at a point diagonally upper right of it or at a point diagonally lower left of it, then the switching element 3*b* and the switching element 3*h* in the next set, or the switching element 3*d* and the switching element 3*e* in the next set, will be turned on at the same time, and, in this case, both of the motor for the upward and downward movements and the motor for the leftward and rightward movements are supplied with electric power at the same time.

SUMMARY OF THE INVENTION

Therefore, it is an object of the present invention to offer a switching device which is capable of reducing the operating noises without increasing the number of its component parts and can eventually attain a reduction of its cost.

It is another object of the present invention to offer a switching device which, being capable of performing switching operations on a plural number of switching elements by operations for pushing in an operating knob that can be moved in a swinging motion, can overcome the disadvantages that occur when the operating knob has been pushed aslant.

A switching device according to the present invention comprises: a switch body; a base plate provided in the inside of this switch body; an operating knob provided in such a manner that it can be pushed into the above-mentioned switch body; an elastic member which is arranged on the above-mentioned base plate and has a contact holder portion, which, being elastically deformable, operates a first switching element when the elastic member is pushed on the basis of a pushing-in operation performed on the above-mentioned operating knob; a changeover knob provided in the proximity of the above-mentioned operating knob; and a contact holder, which, being disposed on the above-mentioned base plate in such a manner as to be able to slide thereon, performs a switching operation on a second switching element while sliding on the base plate on the basis of an operation of the above-mentioned changeover knob; wherein the elastic member is provided with a buffering member which, being formed in an integrated structure therewith, is put into its direct contact with the contact holder at the terminal point of the sliding movement of the contact holder mentioned above.

A switching device according to the present invention comprises: a switch body; an operating knob, which is formed in an approximately rectangular shape, has corner areas in four locations and also has an operating portions between the individual adjacent corner areas, and is installed on the above-mentioned switch body, in such a manner as to be permitted to slide, so that the operating knob can move aslant in any of four directions on the basis of the pushing-in operations on each of the above-mentioned operating parts provided in four locations, the operating knob being returned to the neutral position upon the release of an operation; and a total of eight switching elements provided in pair of two elements each in correspondence to the corner areas in the four locations of the above-mentioned operating knob in the inside of the switch body mentioned above; wherein the switching device wherein these eight switching elements perform a normal switching operation when the four switching elements each provided on both the sides of the operating part put into its operation.

With the means described above, the contact holder will get into its direct contact with the buffering member when the contact holder is moved to the terminal position of its sliding movement by means of the second operating knob, so that this switching device is capable of reducing the collision noises. In this case, the buffering member is formed in an integrated structure with the elastic member, the number of the component parts is not increased because of the use of the buffering member.

With the means described above, only the two switching elements disposed in the corner area will be turned on when the operating knob has been pushed aslant, and the structure of the switching device prevents the switching elements in neighboring pairs from being turned on as in the operation of the prior art switching device, so that the switching elements are operated under the same condition for each set thereof.

DETAILED DESCRIPTION OF PREFERRED EMBODIMENTS

First embodiement

Figure 1:
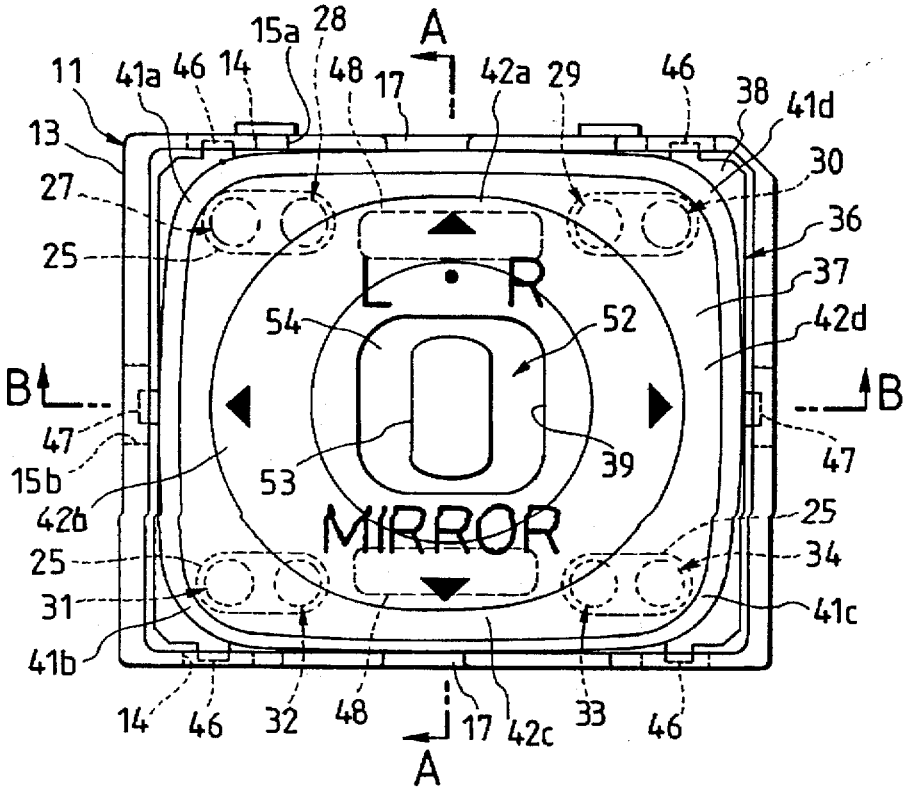
FIG. 1 is a plan view illustrating a first example of preferred embodiment of the present invention.
Figure 2:
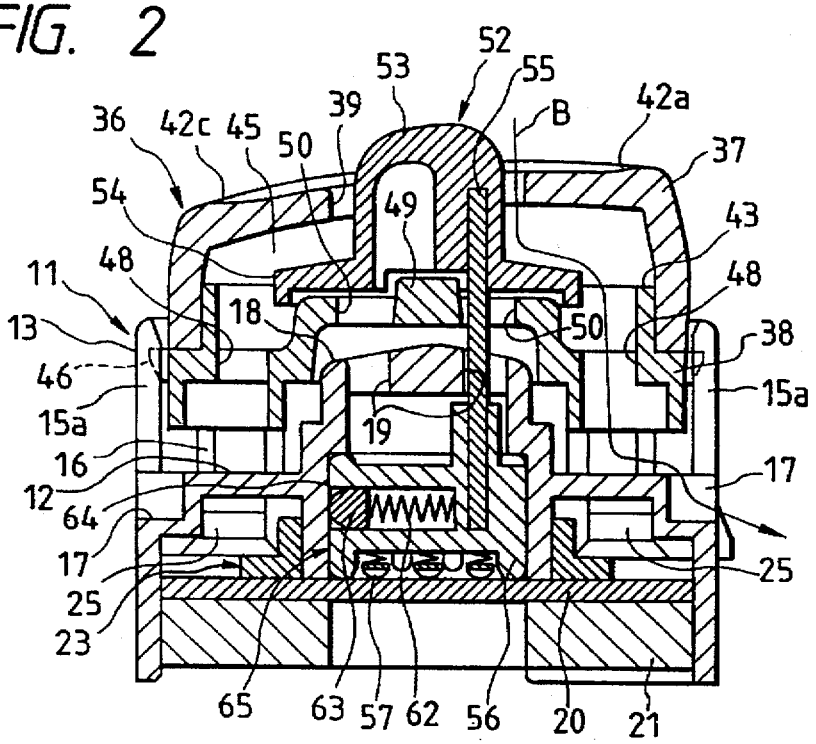
FIG. 2 is a sectional view illustrating the switching device taken along the line A—A in FIG. 1.
Figure 3:
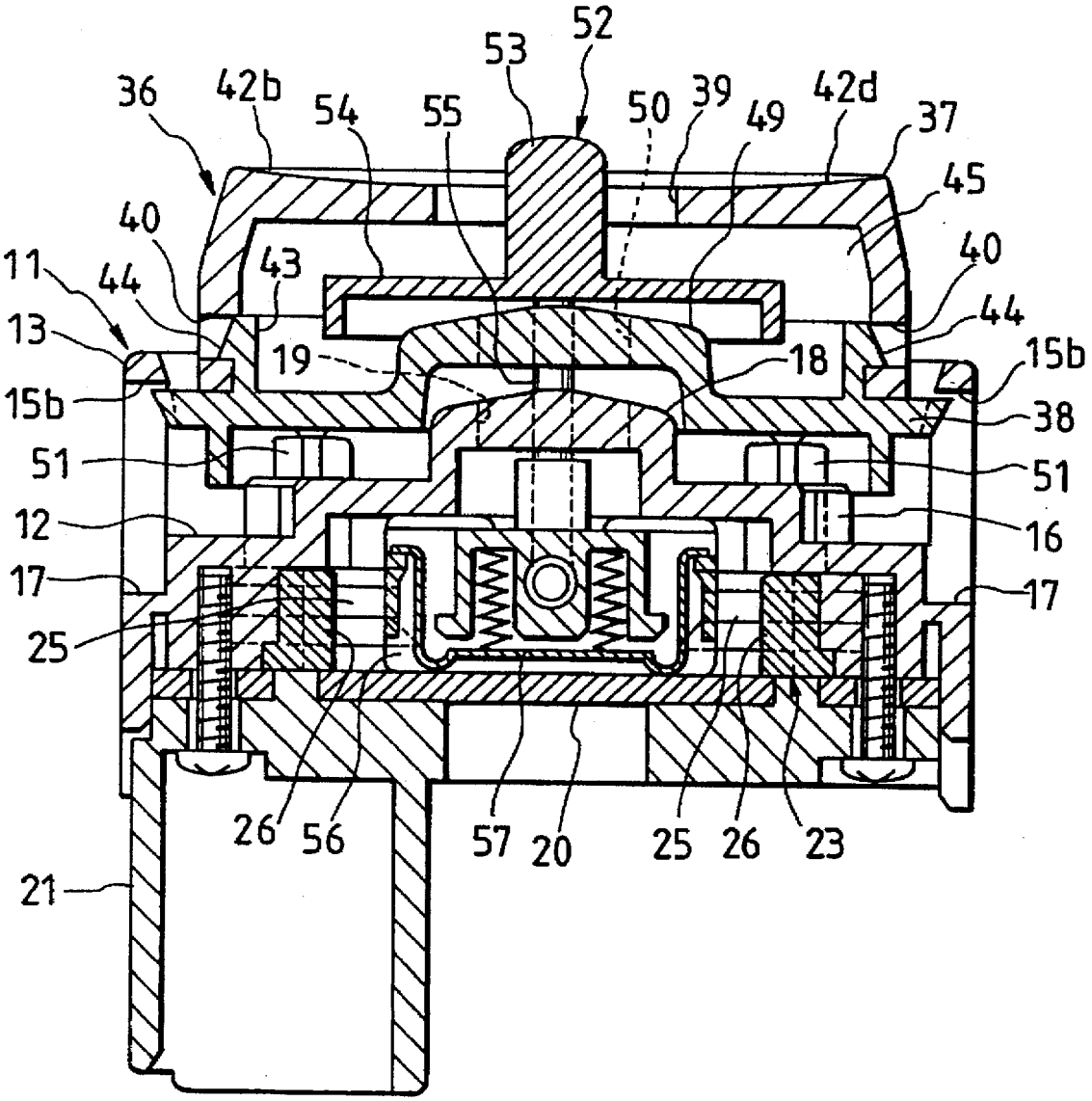
FIG. 3 is a sectional view illustrating the switching device taken along the line B—B in FIG. 1.
Figure 4:
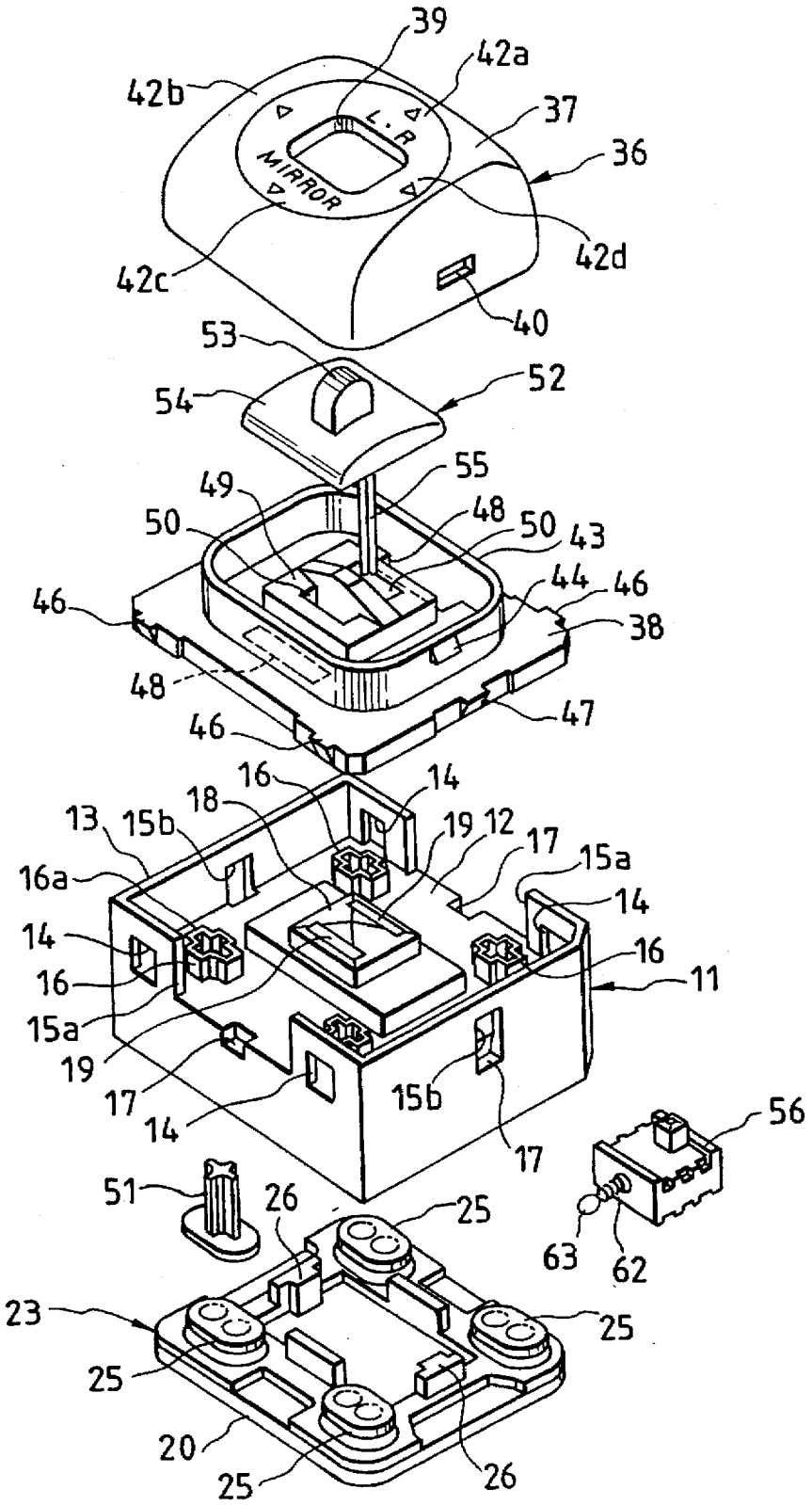
FIG. 4 is an exploded perspective view illustrating the principal component parts of the switching device according to the present invention.

In the following part, a description will be made of a first example of preferred embodiment of the present invention with reference to FIG. 1 through FIG. 8.

First, as shown in FIG. 1 through FIG. 4, a switch body formed in an approximately rectangular shape has a partition plate 12 set up therein to partition the inside region of the switch body into two parts, namely, the upper and lower areas of the switch body, and the upper and lower surfaces of the partition plate 12 are kept open. A riser wall 13 formed in the upper portion of the switch body 11 has an engaging hole 14 made in each of the four locations, namely, the front area, the rear area, the left area, and the right area of the switch body 11. Further, a water drain opening 15*a* with its upper part kept open is formed in each of the two areas, namely, the front area and the rear area, and also a water drain opening 15*b* with its upper part kept closed is formed in each of the two locations, namely, the left area and the right area of the switch body 11.

The partition plate 12 mentioned above has a guide part 16 having an insertion hole 16*a* formed in an approximately cross shape in each of its four corner areas, and also a notched concave part 17 for draining the water is formed in each of the four locations. The upper part of each guide part 16 is formed at a level higher than the upper surface of the partition plate 12. The notched concave parts 17 formed in the four locations are respectively in intercommunication with the above-mentioned water drain openings 15*a* and 15*b*. Also, in an approximately central area of the partition plate 12, a protruding part 18 is formed to attain an elevation higher than the upper surface of the partition plate 12, and this protruding part 18 has a long insertion hole 19 formed in the leftward-rightward direction in each of two locations in its front and its rear respectively.

Figure 5:
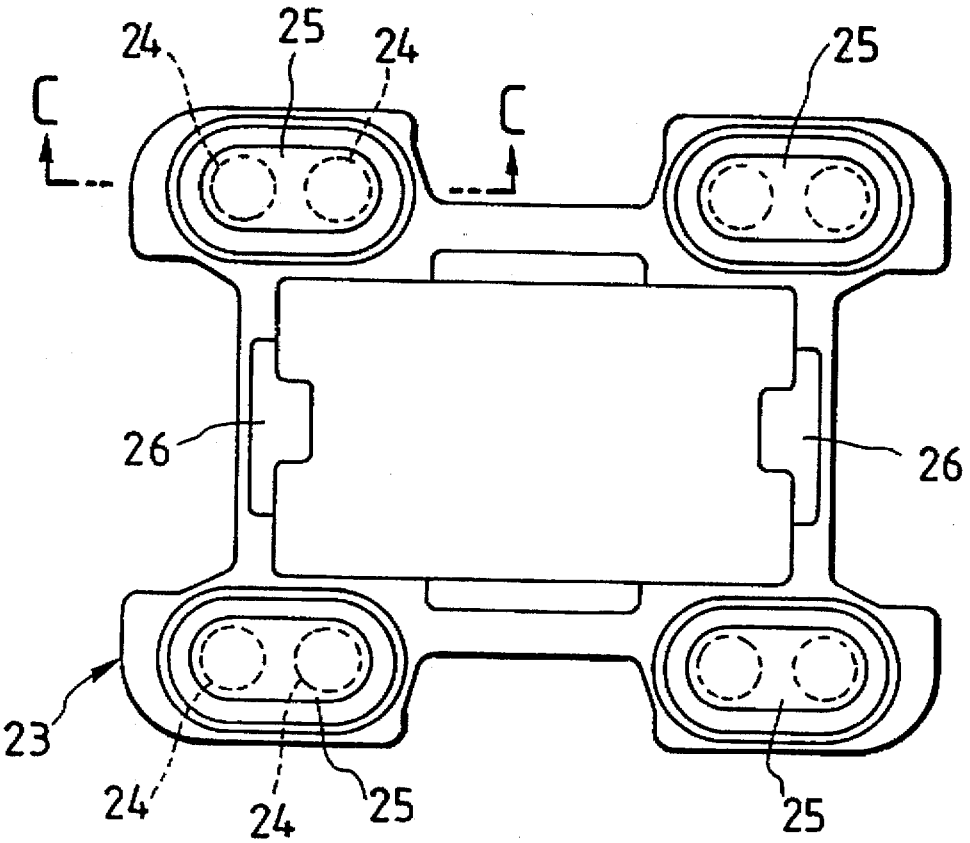
FIGS. 5 a plan view illustrating an elastic member of the switching device according to the present invention.
Figure 6:
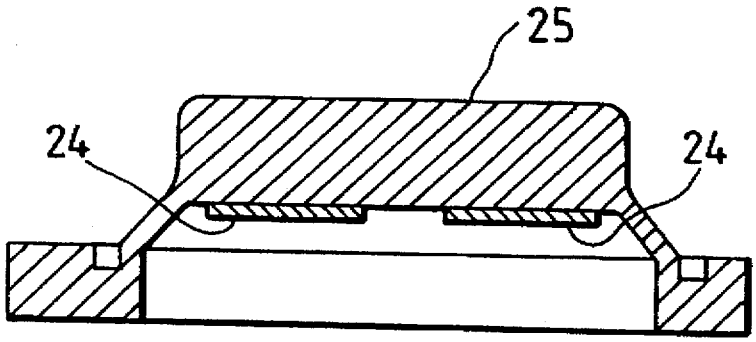
FIG. 6 is an enlarged sectional view of the elastic member taken along the line C—C as shown in FIG. 5.
Figure 7:
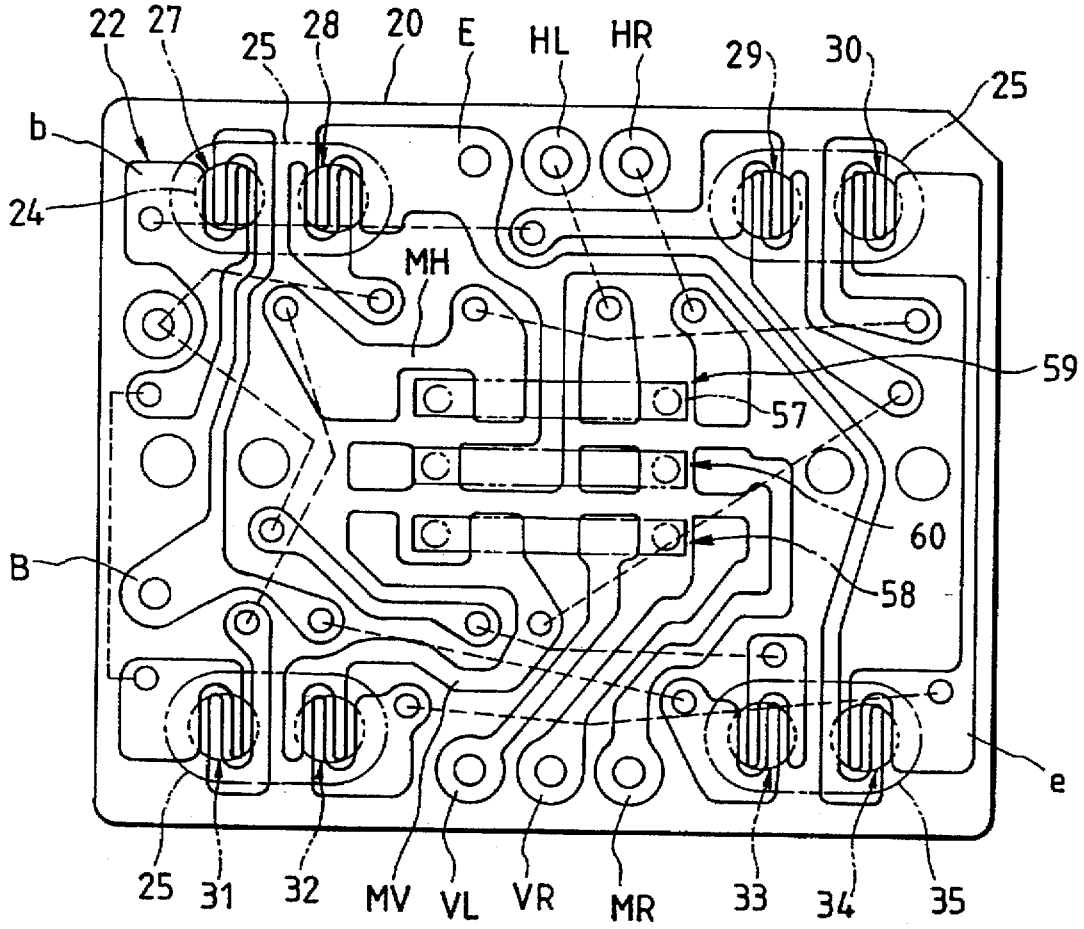
FIG. 7 is a plan view showing the wiring board.

In the lower part of the switch body 11, a wiring board 20 is disposed for use as a substrate, and also a connector 21 is provided below this wiring board 20. As shown in FIG. 7, a wiring pattern 22 is formed on the wiring board 20. Moreover, an elastic member 23, which is made, for example, of silicone rubber, is disposed on the wiring board 20, as shown in FIG. 5.

The elastic member 23 is formed in a rectangular frame shape as a whole and is provided with a contact holder part 25, which is elastically deformable and has two movable contacts 24 (Refer to FIG. 6) each on the inside surfaces of the four corners corresponding to the lower area of the guide part 16 mentioned above. Further, a buffering part 26, which is formed in an approximately T-letter shape, is formed in two mutually confronting locations on the left and right shorter sides of the four sides of this elastic member 23 in such a manner that the buffering part 26 constitutes an integrated structure with this elastic member 23.

Figure 8:
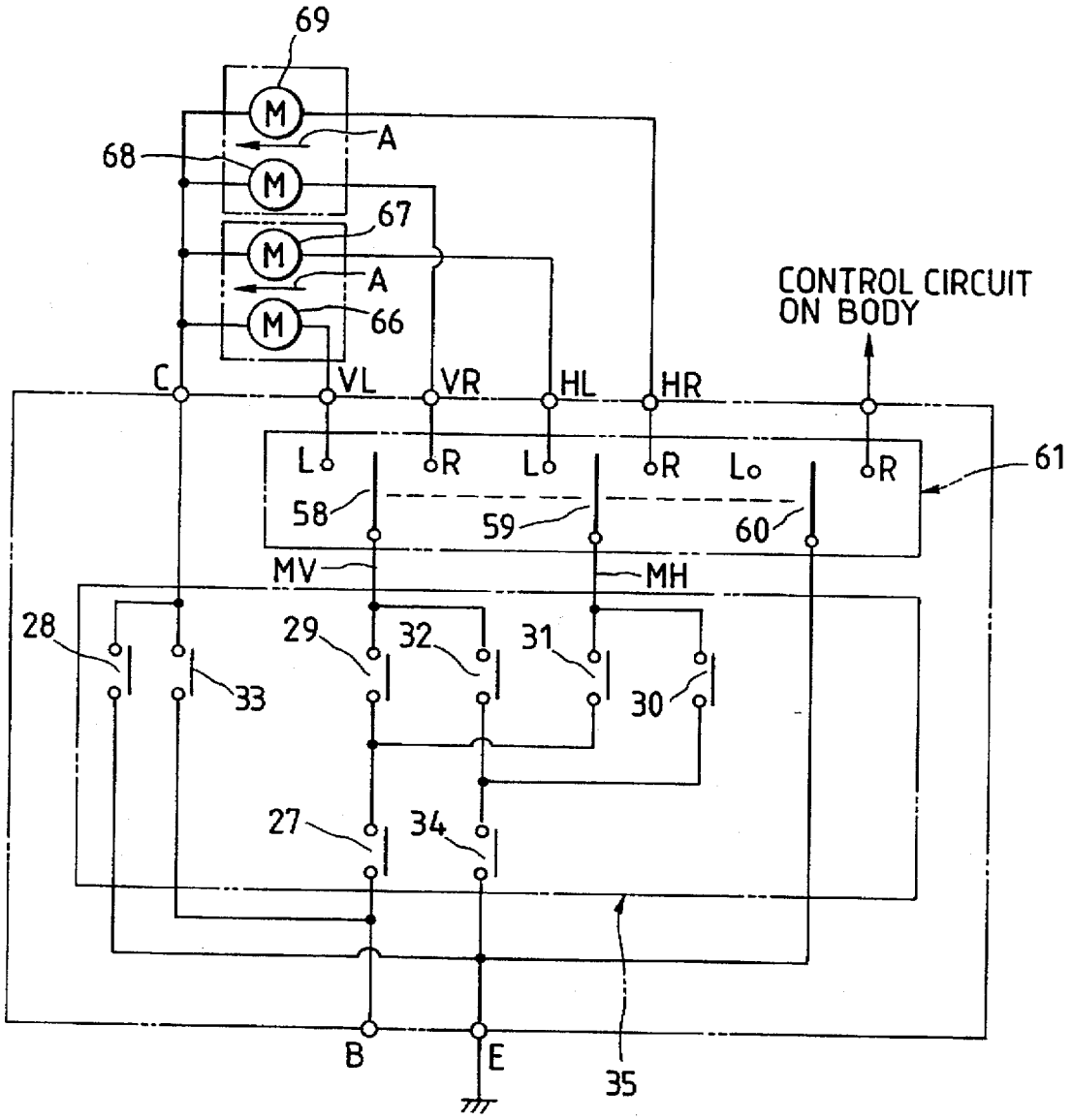
FIG. 8 is an electrical circuit diagram.

Here, as shown in FIG. 7, the eight movable contacts 24 provided on the four contact holder parts 25 of the elastic member 23 and the stationary contacts of the wiring pattern 22 on the wiring board 20 together form eight switching elements 27 through 34, as shown in FIG. 7, and these switching elements 27 through 34 form an operating switch 35 for operating a motor for a mirror, as shown in FIG. 8.

On the upper area of the switch body 11, a first operating knob 36 formed in an approximately rectangular shape is disposed for its use as an operating knob. This first operating knob 36 is composed of two component parts, i.e., an operating member 37 provided in its upper portion and a retaining member 38 provided in its lower portion. Of these component parts, the operating member 37 has an opening 39 formed in a rectangular shape in its central area, with an engaging hole 40 made in the side area between the left part and the right part. Further, the operating member 37 uses the portions between adjacent individual corner parts 41*a* through 41*d*, out of the corner areas 41*a* through 41*d* in the four locations, as operating parts 42*a* through 42*d* (Refer to FIG. 1). Four marks or characters each indicating an operating direction are displayed in positions corresponding to the operating parts 42*a* to 42*d* on the upper surface of the operating member 37.

In contrast with this, an annular wall 43 in a rectangular frame shape is formed on the upper surface of the retaining member 38, and the operating member 37 set so as to form a structure unified with the retaining member 38, with the engaging pawls 44 formed in both the left and right sides of this annular wall 43 being set in the engaging hole 40 made in the operating member 37. An empty area 45 is formed between these two members, namely, the operating member 37 and the retaining member 38.

Out of the peripheral edge portion of the retaining member 38, both the left and right side portions of the front edge portion and the rear edge portion have variable hinges 46 made of projecting parts are formed in a total of four locations, and projecting parts 47 are formed in two locations in the left edge portion and the right edge portion. Of these parts, the four variable hinges 46 are respectively inserted into the above-mentioned engaging holes 14 made in the switch body 11 in such a manner as to permit each of them to move in the upward-downward direction, and the two projecting parts 47 are respectively inserted into the water drain openings 15*b* in such a manner as to permit each of them to move in the upward-downward direction.

Further, the retaining member 38 has a water drain hole 48 made in each of two locations positioned in the front part and the rear part of the outer peripheral portion in the inside of the annular wall 43. A protruding part 49, which is at a level higher than the surrounding area, is formed in the central area of the retaining member 38, and insertion holes 50 longer in the leftward-rightward direction and in its communication with the insertion hole 19 in the switch body 11, respectively, are made in two locations in this protruding part 49.

Then, a push rod 51 is inserted into an insertion hole 16*a* made in each of the guide parts 16 in four locations in the switch body 11. This push rod 51 is in direct contact at its lower end portion as set from above with the contact holder part 25, and its upper end portion is held in its direct contact, as set from below, with the lower surface of the retaining member 38 in the first operating knob 36. The first operating knob 36 is urged toward the neutral position by the elastic force applied by each contact holder part 25 by way of each push rod 51, and the first operating knob 36 is thereby kept ready for its swinging motion in any of the four directions, i.e., forward, backward, leftward, and rightward, in accordance with the pushing-in operations in the forward, backward, leftward, and rightward, of the operating parts 42*a* through 42*d* respectively provided in four locations, and the first operating knob 36 is thus constructed in such a manner as to operate the contact holder part 25 by applying its pressing force thereto via the push rod 51 in accordance with the direction of its sliding movement.

Here, it is observed with reference to FIG. 1 that the eight switching elements 27 through 34 mentioned above are provided in sets each composed of two switching elements in correspondence with the corner parts 41*a* through 41*d* provided in four locations in the operating knob 36.

A second operating knob 52 for a changeover between the left and the right is provided in the inside of the first operating knob 36. This second operating knob 52 has an operating part 53 disposed in the opening 39 of the operating member 37, an eaves part 54, which is formed in a rectangular shape larger than the opening 39 and, being applied from above, covers up the insertion hole 50 of the retaining member 38, and a lever 55, which extends in the upward-downward direction, and the lever 55 is inserted into the insertion holes 50 and 19 made respectively in the rear sides of the retaining member 38 and the switch body 11.

The lower end portion of the lever 55 is fitted into the contact holder 56, and this contact holder 56 is disposed in an approximately central area of the above-mentioned wiring board 20 in such a manner as to be permitted to slide in the leftward-rightward direction. The contact holder 56 is provided with three movable contacts 57 (Refer to FIG. 7). These three movable contacts 57 and the stationary contacts provided in the central area of the wiring pattern 22 on the wiring board 20 form three sliding switches 58 through 60, and these three switches 58 through 60 constitute a changeover switch 61 for selecting one of the left mirror and the right mirror.

In the central area in the front of the contact holder 56, a spring 62 and a moderating piece 63 are provided, and, in correspondence with this, a moderating wall 64 (Refer to FIG. 2) is provided on the side of the switch body 11, and this spring 62, this moderating piece 63, and the moderating wall 64 together form a moderating mechanism 65.

Further, the contact holder 56 is constructed so as to be set into its sliding motion in the leftward-rightward direction by means of the second operating knob 52 and also to be held in a neutral position in the central area in the leftward-rightward direction and also in the leftward-rightward operating position by the action of the moderating mechanism 65. Moreover, the contact holder 56 is constructed in such a manner that an end portion of this contact holder 56 will be brought into its direct contact with the buffering part 26 when the contact holder 56 has moved to the sliding movement terminal position, which is an operating position for a leftward movement and a rightward movement.]

In FIG. 8, which illustrates the electrical construction, the reference number 66 denotes a motor for an upward or downward adjustment of the mirror on the left side out of the left and right mirrors (not shown in FIG. 8), the reference number 67 similarly denotes a motor for a leftward or rightward adjustment of the mirror on the left side, and the reference number 68 denotes a motor for an upward or downward adjustment of the mirror on the right side, and the reference number 69 similarly denotes a motor for a leftward or rightward adjustment of the mirror on the right side. These motors are respectively connected as shown in FIG. 8. In FIG. 7, moreover, the parts indicated by the broken line show the pattern connected on the back side of the wiring board 20.

Then, the effects produced by the construction described above will be described.

When the second operating knob 52 is operated so as to slide it in the leftward direction, for example, in the state in which both the first operating knob 36 and the second operating knob 52 are held in the neutral position (Refer to FIGS. 1 to 3), the contact holder 56 will slide in the leftward direction by way of the lever 55, and, along with this, the individual sliding switches 58 through 60 of the changeover switch 61 are changed to the left side as shown in FIG. 8 and are kept in that state. By this, the motors 66 and 67 for the mirror on the left side are selected.

At this time, as the contact holder 56 is moved to the terminal position of its sliding movement on the left side, the left end portion of the contact holder 56 will be brought into its direct contact with the buffering member 26 on the left side, and the collision noises caused on such an occasion will therefore be reduced.

When the upward operating part **42*a* on the first operating knob 36 is operated so as to be pushed in while the second operating knob 52 is in the state of having been operated to be on the left side, the first operating knob 36 will be moved so as to be inclined toward the back side on the variable hinges 46 and 46 in the front edge area working as the supporting points, so that the contact holder parts 25 and 25 in two locations on the rear side are pushed down via the push rods 51 and 51, the four switching elements 27 through 30 on the rear side being thereby turned on. Then, in the construction shown in FIG. 8, an electric current flows in the direction marked by the arrow A to be applied to the motor 66** for an upward or downward adjustment of the mirror on the left side, and, along with this, the mirror on the left side is turned upward.

Moreover, when the operating force applied to the first operating knob 36 is released, the first operating knob 36 will be returned to the neutral position by the urging force exerted by the individual contact holder parts 25, and, at the same time, the individual switching elements 27 through 30 are put into an off-state.

When the downward operating part **42*c* of the first operating knob 36 is operated so as to be pushed in, the first operating knob 36 will be moved so as to be inclined toward the front side on the variable hinges 46 and 46 in the rear edge part working as the supporting points, so that the contact holder parts 25 and 25 provided in two locations on the front side are pressed down by way of the push rods 51 and 51, the four switching elements 31 through 34 on the front side being thereby turned on. Then, in the construction shown in FIG. 8, an electric current flows in the direction reverse to the direction indicated by the arrow A to be applied to the motor 66** for an upward or downward adjustment of the mirror on the left side, and, along with this, the mirror on the left side is turned downward.

Further, in case the leftward operating part **42*b* of the first operating knob 36 is operated so as to be pushed in, the first operating knob 36 will be moved so as to be inclined toward the left side on the variable hinges 46 and 46 on the right side working as the supporting points, so that the contact holders 25 and 25 provided in two locations on the left side are pressed down by way of the push rods 51 and 51, the four switching elements 27, 28, 31, and 32 on the left side are thereby turned on. Then, in the construction shown in FIG. 8, an electric current flows in the direction marked by the arrow A to be applied to the motor 67** for a leftward-rightward adjustment of the mirror on the left side, and, along with this, the mirror on the left side is turned leftward.

Further, in case the rightward operating part **42*d* of the first operating knob 36 is operated so as to be pushed in, the first operating knob 36 will be moved so as to be inclined toward the right side on the variable hinges 46 and 46 on the left side working as the supporting points, so that the contact holders 25 and 25 provided in two locations on the right side are pressed down by way of the push rods 51 and 51, the four switching elements 29, 28, 33, and 34 on the right side are thereby turned on. Then, in the construction shown in FIG. 8, an electric current flows in the direction reverse to the direction marked by the arrow A to be applied to the motors 68 and 69** for a leftward-rightward adjustment of the mirror on the right side, and, along with this, the mirror on the right side is turned rightward.

In the meantime, when the second operating knob 52 is operating so as to slide in the rightward direction, which is reverse to the direction mentioned above, in the state in which both the first operating knob 36 and the second operating knob 52 are held in the neutral position, the contact holder 56 will slide in the rightward direction by way of the lever 55, and, along with this, the individual sliding switches 58 through 60 of the changeover switch 61 are changed to the right side in the construction shown in FIG. 8, and the state is maintained. By this, the motors 68 and 69 for the mirror on the right side will be selected.

At such a time, as the contact holder 56 moves to the terminal point for the sliding movement on the right side, the right end portion of the contact holder 56 will be brought into its direct contact with the buffering part 26 provided on the right side of the elastic member 23, and the collision noises generated on that occasion are thereby reduced.

Further, in case the individual operating parts 42*a* through 42*d* of the first operating knob 36 are operated so as to be pushed in while the second operating knob 52 is operated for a movement to the right side, the motor 68 for an upward-downward adjustment of the mirror on the right side will be selected in stead of the motor 66 for an upward-downward adjustment of the mirror on the left side as described above and the motor 69 for a leftward-rightward adjustment of the mirror on the right side is selected in stead of the motor 67 for a leftward-rightward adjustment of the mirror on the left side, and, since the effect of the operations are the same except for these points, a description of the operations is omitted here.

Here, in case the first operating knob 36 has been pushed aslant in the state in which the second operating knob 52 is operated to move to the left side or to the right side, i.e., in case one location of the corner areas 41*a* through 41*d* is pushed down, the switching elements in sets of two switching elements, i.e., 27 and 28, 31 and 32, 33 and 34, and 29 and 30, corresponding to the corner areas so operated have been operated so as to be turned on, but, in either of these cases, no power conducting path will be formed to any of the motors 66 through 69.

On the other hand, in case any water happens to come into its contact, for example, with the first operating knob 36 and to intrude into the inside of the central area through the opening 39, the intrusive water will flow along the outer surfaces of the operating member 53 and the eaves part 54 of the second operating knob 52, and will be received by the retaining member 38 of the first operating knob 36. Then, the intrusive water flows down onto the partition plate 12 of the switch body 11 through the water drain hole 48 made on the side of the outer peripheral area of the retaining member 38 and will then be discharged to the outside of the switch body 11 through the notched concave part 17 and the water drain openings 15*a* and 15*b*.

Further, in a case in which water has intruded into the inside of the switch body 11 from the peripheral edge portion of the first operating knob 36, the intrusive water will be received on the partition plate 12 and will be discharged thereafter into an area outside of the switch body 11 through the notched concave part 17 and through the water drain openings 15*a* and 15*b* in the same way as in the case described above.

According to the first example of preferred embodiment of the present invention described above, all the eight switching elements 27 through 34, which are operated on the basis of the operation of the first operating knob 36, are disposed in sets each consisting of two elements in locations corresponding to the corner parts 41*a* through 41*d* of the first operating knob 36, so that only the two switching elements 27 and 28, 31 and 32, 33 and 34, or 29 and 30 which are disposed in each corner part will be operated so as to be turned on, in case the first operating knob 36 is pushed aslant, and it will not happen in this construction that the switching elements in adjacent sets are turned on at the same time as is the case with the prior art switching device.

Further, according to the construction of the switching device described herein, it is possible surely to turn on only the four switching elements which should be operated, since the switching device is not liable to cause any such trouble as incompletely operating the four switching elements located on the side opposite to the operating parts which have been HR and the two terminals B and E have been short-circuited and thereby judges which switches (the eight switching elements 27 through 34 and the sliding switch 58 through 60) have been operated and then controls the individual motors 66 through 69 by way of a driving circuit 71 on the basis of the judgment concerning the operated switches.

Further, in this second example of preferred embodiment, the control circuit does not need any signal from the two switching elements 28 and 33 connected to the terminal C, among the eight switching elements 27 through 34, for the purpose of controlling the motors 66 through 69, and these two switching elements 28 and 33 are, so to speak, in an idle state.

As described so far, the switching device according to the present invention may be applied to both of the direct operation type switching device shown in the first example of preferred embodiment and the switching device which may be called the indirect operation type using a micro computer as shown in the second example of preferred embodiment.

As it is obvious from the description given above, the present invention offers a switching device formed in a construction in which a contact holder runs against a buffering part when the contact holder is moved to the terminal position of its sliding movement, so that the construction of this switching device can reduce the collision noises, i.e., the operating noises. Even in such a case, the switching device operated, in case the operating part in one location out of the operating parts 42*a* through 42*d* of the first operating knob 36 has been operated so as to be pushed in.

Yet, with such a switching device like the one described above, the four variable hinges 46 for the first operating knob 36 are provided, in general, in the square areas in four locations of the first operating knob 36. However, in case those variable hinges 46 are provided in the square areas of the first operating knob 36, even a slight change in the external shape of the first operating knob 36 for a change of its design or the like will result also in a change of the distance between the individual variable hinges 46, so that each such change requires that an examination should be conducted on each such occasion on the amount of the stroke of the first operating knob 36 and eventually on the amount of the elastic deformation and so on for each of the individual contact holder parts 25 in the elastic member 23.

In this respect, this example of preferred embodiment is provided with four variable hinges 46 of the first operating knob 36, but these variable hinges 46 are formed not in any square portion but in locations slightly closer to the central portion of the switch body 11 (Refer to FIG. 1), so that it will not be necessary to change the distance between the individual variable hinges 46 even in a case in which the external shape of the first operating knob 36 has been changed slightly in the leftward-rightward direction by reason of a design change or the like. Therefore, the construction of the switching device in this example of preferred embodiment offers the advantage that the construction does not require any case-by-case examination of the amount of stroke of the first operating knob 36 and the amount of elastic deformation and the like in each of the contact holder part 25 in the elastic member 23.

Second embodiment

Figure 9:
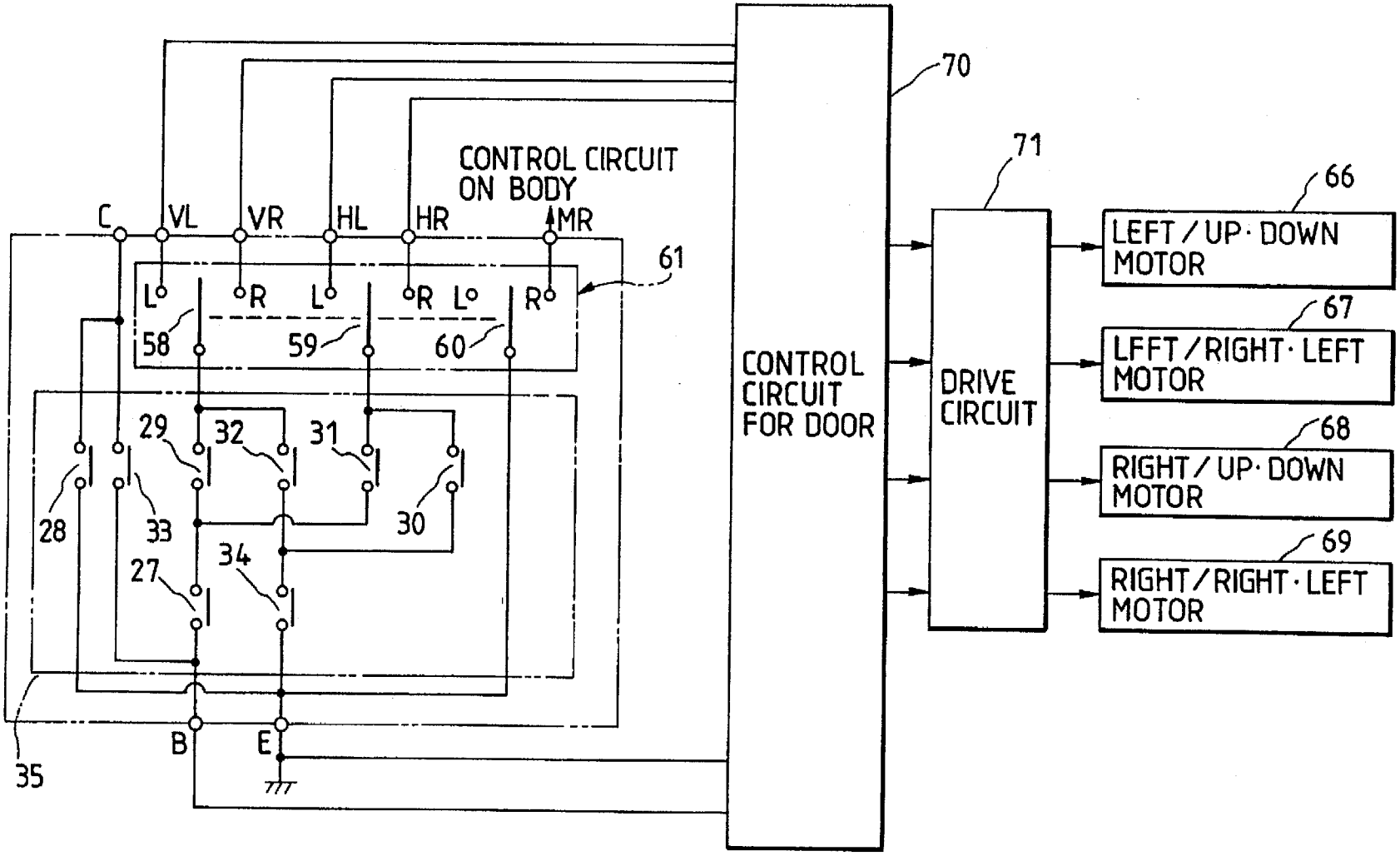
FIG. 9 is a chart corresponding to FIG. 8 and illustrating a second example of preferred embodiment of the present invention.
Figure 10:
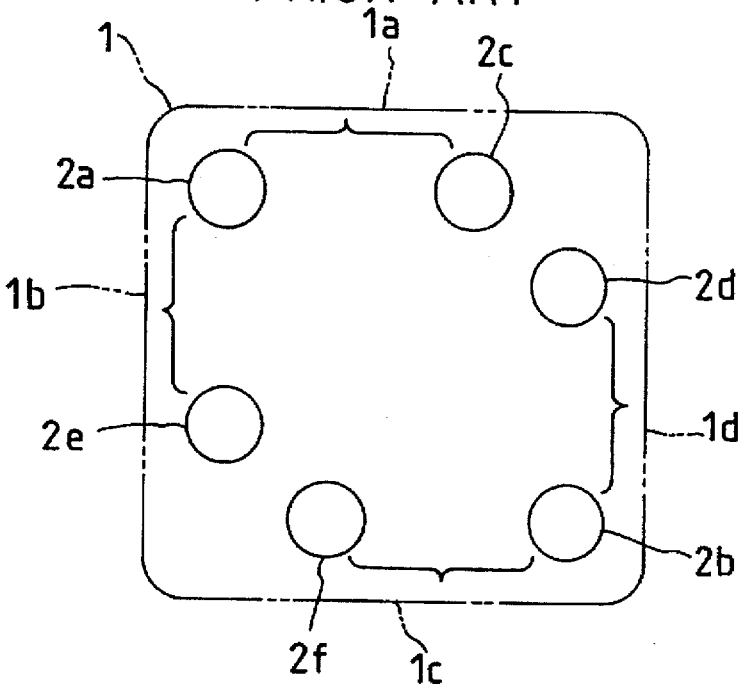
FIG. 10 PRIOR ART
FIG. 10 is a diagram illustrating the arrangement of the switching elements of a switching device in the prior art construction.
Figure 11:
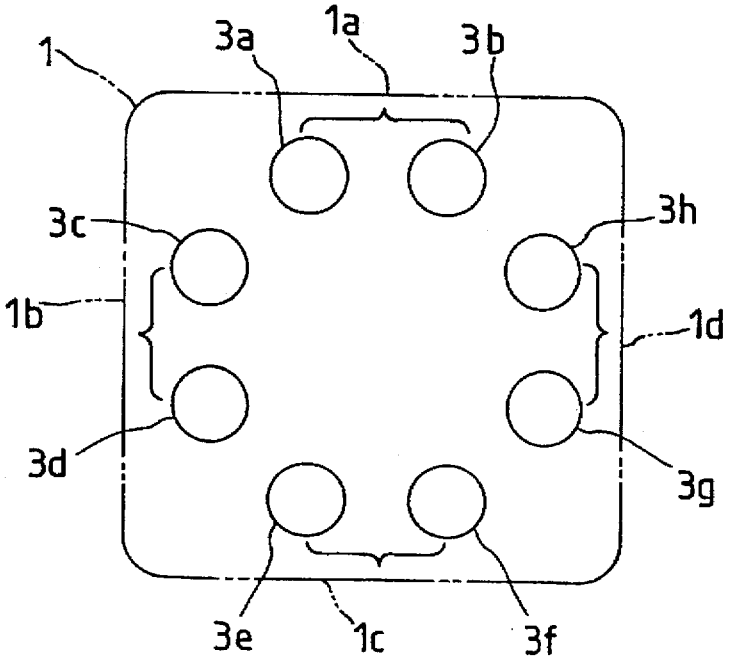
FIG. 11 PRIOR ART
FIG. 11 is a diagram corresponding to FIG. 10 and showing a switching device in another prior art construction.

FIG. 9 shows a second example of preferred embodiment of the present invention, and this example is different in the following respects from the first example of preferred embodiment of the present invention as described above.

Specifically, in the case of the first example of preferred embodiment described above, the present invention is applied to a construction for a direct control in which the individual motors 66 through 69 are controlled directly for turning on and off the electric power supplied to them with the operating switch 35 (comprising eight switching elements 27 through 34) and the changeover switch 61 (comprising the sliding switches 58 through 60), but the second example of preferred embodiment shown in FIG. 9 features a construction in which the individual motors 66 through 69 are controlled by means of a door-mounted control circuit 70 provided with a micro computer.

In this case, the door-mounted control circuit 70 judges which terminals among the four terminals VL, VR, HL, and does not require any increase in the number of its component parts since this switching device has the buffering member in a structure integrated with an elastic member having a contact holder part capable of undergoing an elastic deformation when it is pressed down under a pressing force generated by an operation for pressing a first operating knob. Accordingly, the present invention can reduce the operating noises of the switching device without any increase in the number of its component parts and can eventually attain a reduction of cos As it is also obvious from the description given above, the present invention offers a switching device which is operated by switching operations performed on a plural number of switching elements by operations for pushing down an operating knob which can be set into its swinging motion in four directions, and the switching device is provided with eight switching elements disposed in sets of two switching elements in each as arranged in correspondence with the corner areas in four locations of the operating knob, and, even if the operating knob is pushed aslant, it will therefore not happen that switching elements in adjacent sets are turned on at the same time as is the case with the prior art switching device, and the operating knob attains the same condition in whatever direction it is pushed aslant. Thus, the present invention can eliminate the disadvantage which the prior art switching device produces when the operating knob is pushed aslant.

What is claimed is:

1. A switching device comprising:

a switch body;

a push-type operation knob in the switch body, the operation knob having an approximate rectangular shape to provide four adjacent corner areas, the operation knob further having operation parts between each of the adjacent corner areas; and each of the corner areas having a switching member, the switching members being disposed and electrically connected to one another so that in response to depressing one of the operation parts the switching members at the adjacent corner areas of the operation part are operated and a normal switching operation occurs, and in response to depressing the operation knob in such a manner that only one of the switching members is operated a normal switching operation is prevented.

2. A switching device as claimed in claim 1, wherein each of the switching members has an elastic member, the elastic member having a contact holder portion for switching the switching member in response to depressing one of the operation parts.

3. A switching device as claimed in claim 2, wherein each of the switching members have a pair of movable contacts mounted to the contact holder portion of the elastic member, and have a pair of stationary contacts mounted to a base plate provided in the switch body, so that in response to depressing one of the operation parts at least one pair of movable contacts comes into contact with the corresponding pair of stationary contacts.

4. A switching device as claimed in claim 2, wherein the contact holder portion of the elastic member is deformed in a substantially vertical direction in response to depressing one of the operation parts.

5. A switching device as claimed in claim 1, wherein the operation knob has at least one variable hinge connected to the switch body for operating at least one switch member in response to depressing one of the operation parts.

6. A switching device as claimed in claim 5, wherein the operation knob is mounted for depressing the operation knob in multiple directions.

7. A switching device as claimed in claim 1, wherein a normal switching operation is prevented in response to pushing the operation knob to operate switch members at at least three of the corner areas.

8. A switching device comprising:

a switch body;

a base plate provided in the switch body;

a push-type operation knob in the switch body, the operation knob having an approximate rectangular shape to provide adjacent corner areas, the operation knob further having operation parts between each of the adjacent corner areas;

each of the corner areas having an elastically deformable contact holder portion;

at least one movable contact is mounted to each contact holder portion; and at least one stationary contact is mounted to the base plate in relative disposition to each movable contact, the stationary contacts being electrically connected to one another so that in response to depressing one of the operation parts the movable contacts at the adjacent corner areas of the operation part are brought into contact with the corresponding stationary contacts and a normal switching operation occurs, and in response to depressing the operation knob in such a manner that only one of the moveable contacts comes into contact with one of the stationary contacts a normal switching operation is prevented.

* * * * *